US006514181B1

(12) United States Patent
Taylor

(10) Patent No.: US 6,514,181 B1
(45) Date of Patent: Feb. 4, 2003

(54) APPARATUS PROVIDING DOUBLE-POLING SKI-MOVEMENT AND METHOD FOR MAKING SAME

(76) Inventor: Richard W. Taylor, P.O. Box 16, Bethel, ME (US) 04217

( * ) Notice: Subject to any disclaimer, the term of this patent is extended or adjusted under 35 U.S.C. 154(b) by 112 days.

(21) Appl. No.: 09/628,953

(22) Filed: Jul. 29, 2000

(51) Int. Cl.[7] ..... A63B 21/02; A63B 21/00
(52) U.S. Cl. ..... 482/72; 482/51; 482/138
(58) Field of Search ..... 482/51, 70, 71, 482/72, 908, 100–106, 138

(56) References Cited

U.S. PATENT DOCUMENTS 4,358,108 A * 11/1982 Voris ..... 482/99
4,396,188 A 8/1983 Dreissigacker et al.
4,659,077 A 4/1987 Stropkay
4,743,015 A 5/1988 Marshall
4,875,674 A 10/1989 Dreissigacker et al.
D305,256 S * 12/1989 Pearson ..... D21/198
4,943,051 A * 7/1990 Haskins et al. ..... 272/72
4,949,951 A * 8/1990 Deola ..... 482/100
4,960,276 A 10/1990 Feuer et al.
5,042,797 A * 8/1991 Graham ..... 272/120
5,299,996 A 4/1994 Chi
5,536,225 A 7/1996 Neuberg et al.
5,702,334 A * 12/1997 Lee ..... 482/140
5,707,322 A * 1/1998 Dreissigacker et al. ..... 482/72
5,961,427 A * 10/1999 Habing et al. ..... 482/138
6,120,419 A * 9/2000 Huang ..... 482/138

OTHER PUBLICATIONS

Arnold Schwarzenegger Encyclopedia of Mordern Body-building 1987 Published by Simon & Schuster Inc. p. 347.*
Body Solid Fitness Equipment and Free Weights pp. 1,23–24 Copyright 1993.*

* cited by examiner

*Primary Examiner*—Stephen R. Crow
(74) *Attorney, Agent, or Firm*—Patricia M. Mathers; Thomas L. Bohan

(57) ABSTRACT

Apparatus and Method providing optimal duplication of the double-poling technique used in cross-county skiing. The apparatus includes dual hand grips that are adapted to "wrap" around a user's torso. The dual hand grips are attached by a cable or other suitable connector to a force generator. Because of the shape of the dual hand grips, the user can perform near-ideal double-poling technique in which the dual hand grips are first positioned above and in front of a user, and are then moved in a downward arc with the dual hand grips moving past the body plane to a movement-ending position in back of the person. In the Method of the present invention, a suitable stationary-rowing machine is adapted and modified to exhibit the characteristics of the Apparatus of the present invention. The longitudinal frame of such a stationary-rowing machine is placed in a substantially vertical orientation and the dual hand grips are interlocked with the operator handle of the stationary-rowing machine.

7 Claims, 3 Drawing Sheets

APPARATUS PROVIDING DOUBLE-POLING SKI-MOVEMENT AND METHOD FOR MAKING SAME

BACKGROUND OF THE INVENTION

1. Field of the Invention

The present invention relates to the field of sport-specific movement. More specifically, the present invention relates to such movement obtained through the use of an exercise-apparatus. More specifically still, the present invention relates to such movement that biomechanically duplicates the movement of the "double-poling" technique in cross-county skiing.

2. Description of Related Art

There are two basic forms of cross-country skiing: modern "skating" style; and traditional style. The modern skating style requires both arms to move together 99% of the time, and hence is characterized as "double-poling." In traditional style cross-country skiing, both double-poling and single-poling—where the arms move in alternation—are used. Various methods and devices have previously endeavored to provide skiers with a way to duplicate the movements an athlete performs during cross-country skiing. Virtually all previous references have been directed to devices with which a person simulates only the single-poling style. These devices have been such that a person pulls with each hand in alternation on separate handles or poles while the person's legs slide or step in alternation, so as to mimic a cross-country skiing stride of the single-poling technique.

An example of a cross-country ski exercise apparatus which is directed to single-poling is taught by Stropkay (U.S. Pat. No. 4,659,077; 1987). The Stropkay apparatus has two longitudinal rails on which are positioned a pair sliding foot-supports. These foot-supports restrain the feet of a person who is using the apparatus from moving laterally. A consequence of this lateral restraint is that the muscles in the person's hip, legs, lower back and abdomen do not support and coordinate the movement of the legs to the degree that they would during 'real' cross-county skiing. The Stropkay apparatus also provides a stomach support for a person exercising on the apparatus. This is unfortunate, since this stomach support diminishes the stabilizing function normally required of the muscles of the stomach and lower back during actual cross-country skiing, thus failing to strengthen this critical link in the required movement. To simulate the striding technique of cross-country skiing, the Stropkay apparatus provides the user with two handles, each attached to one end of a cable that is fitted around a pulley. This arrangement provides the user with only a reciprocating movement for the arms and not the tandem arm movement in the same direction that is essential to the double-poling technique used in cross-country skiing. This reciprocating arm movement further militates against the use of the Stropkay apparatus for double-poling technique.

Marshall (U.S. Pat. No. 4,743,015; 1988) and Chi (U.S. Pat. No. 5,299,996; 1994) each teach a ski-simulator device that is similar to the invention of Stropkay. Common to the Marshall and Chi invention is a pair of foot-supports that slide in a reciprocating fashion along support rails. These foot-supports, because they prevent side-to-side movement, reduce the stabilizing demand on the muscles of the abdomen, back and hip in the same way that the Stropkay apparatus does. The chief difference between the devices of Marshall and Chi in comparison to Stropkay is that the Marshall and Chi devices provide pivotably disposed poles for reciprocating hand-arm movement, whereas the Stropkay invention uses a rope and pulley system. Though the structure is different, the effect on a person who uses the devices is the same: the hands and arms are constrained to reciprocating movement. Consequently, the Marshall and Chi devices are also inappropriate for practice with double-poling.

Another device similar to that of Stropkay is taught by Feuer et al. (U.S. Pat. No. 4,960,276; 1990). The Feuer et al. device also constrains the legs to movement in longitudinal slots, with no lateral movement possible. Thus, Feuer et al. shares the drawbacks of the previously mentioned invention for use as a double-poling exercise device.

A previous skiing-simulation device that does not constrain a user's feet to purely longitudinal movement is that of Neuberg et al. (U.S. Pat. No. 5,536,225; 1996). The Neuberg et al. device, however, is directed toward the movement and techniques of downhill skiing. Consequently, that device, while including poles with handles for a user to grip, does not provide for any movement of these poles. A tandem movement of the arms, as was previously stated, is essential for the double-poling technique of cross-country skiing. An additional attribute of the Neuberg at al. device that renders it unsuitable for use for double-poling is that the device does not provide for any longitudinal movement of the feet relative to the poles. The movement of the arms longitudinally in unison in relation to the feet is essential to the double-poling technique of cross-country skiing.

Therefore what is needed is a device that enables a person to emulate the actual biomechanical motion of the double poling technique of cross-country skiing.

SUMMARY OF THE INVENTION

The present invention provides a method and apparatus with which a person can perform the optimal biomechanical movement used in the double-poling technique of cross-country skiing. The present invention additionally provides a method and apparatus for performing this optimal biomechanical movement in conjunction with certain commercially available rowing machines.

The apparatus of the present invention includes dual hand grips that are connected by a connector to a resistance force generator that acts against the user pulling on the dual hand grips. The connection, as provided by the connector, between the resistance force-generator and the dual hand grips is such that the force a user gripping the dual hand grips pulls against is always directed up from and in front of the user. Most importantly, the dual hand grips of the present invention allow the user to begin a movement cycle with the hands forward of the plane of his or her body and following a smooth continuous movement of both arms in unison, to end with the hands behind the body plane.

In one class of embodiments, the dual hand grips are at the end points of a unitary, U-shaped handle, the concave side of which faces the user. All embodiments of the present invention share the essential quality that the user is able to pull the hands from a position high and in front relative to the shoulders to a position behind the midline (from a side perspective) of the body, something that is impossible to accomplish with a handle having a straight shape. For example, the double-poling handle of the present invention may include two separate ropes, each having a handle on one end. Alternatively, the double-poling handle can include a single section of rope having a hand grip on each end, the section of rope being connected near its middle point to the apparatus.

The force may be supplied by any of the constant or variable resistance force generators used in the exercise-machine field. A non-exhaustive list includes weight-plates, elastomers, flywheels having a bladed fan as a braking means, and fluid dampeners. The magnitude of the force may vary with either the displacement of the hand grips or the speed with which the hand grips are moved. The connector between the dual hand grips and the force generator is typically one or more cables, though other suitably strong and flexible connectors may be used within the scope of the present invention. In the Preferred Embodiment the resistance force generator and the connector are provided by a stationary-rowing machine that has been placed in an upright orientation, while the dual hand grips are part of a U-shaped handle.

The method of the present invention takes advantage of the fact that some stationary-rowing machines already incorporate many of the elements needed for the apparatus of the present invention. The method then consists of converting an existing stationary-rowing machine by orienting it in a vertical position so that the section of the machine that normally is in front of a seated "rower" is now ahead of and above the standing "skier." At that point the dual hand grips are used to replace the "oar" grip simulators of the stationary-rowing machine. An essential aspect of the conversion of the stationary-rowing machine is the positioning so that the "origin" of the stationary-rowing machine's flexible connector is placed above shoulder-height of the user. By "origin", what is meant is the point where the connector separates, on its path to the dual hand grips, from the exercise apparatus—which in the case of the Preferred Embodiment is a pre-existing stationary-rowing machine. A second essential aspect of the method of the present invention is the use of the dual hand grips of the present invention. In the Preferred Embodiment, these hand grips are interlocked over the handle of a pre-existing stationary-rowing machine. In an exemplary embodiment of the present invention, a further step includes performing the double-poling technique with the adapted stationary rowing-machine. Thus, the method of the present invention makes use of the apparatus—in any of its embodiments—of the present invention.

To use this adapted stationary rowing-machine for the double-poling technique, a person stands facing the converted apparatus. The user's left and right hands each grip one end component of the dual hand grip. The user stands with knees slightly flexed and with back basically straight. In a starting position, the arms are extended forward and upward of the shoulders, parallel to one another, with the elbows partially bent, resulting in the person's latissimus dorsi muscles being almost fully extended. (In describing this motion, it is helpful to think of the user's arms as pendulums.) Next, the user pulls the dual hand grips in an arcing motion downward and backward, while the arms simultaneously straighten. During this movement, the linked systems of hip and abdominal flexors, in conjunction with the latissimus dorsi, posterior deltoids and triceps, move the arms/hands toward the knees and thence past the body mid-line (from a perspective to either side of the person) in a forceful pendulum motion. Because the double-poling grips go on either side of the user, the user's hands can be brought to a finishing position behind his or her midline. This allows for optimal force transfer during the double-poling technique and would correspond to the maximum speed that an individual could obtain using the technique during actual skiing. For an additional description on this double-poling technique and the biomechanics involved, see Richard Taylor, The Top Half, Winter 1986 THE PROFESSIONAL SKIER 19.

Three key aspects of the present invention allow a person to perform a near-ideal biomechanical motion for double-poling. The first is that for a person using the present invention, the "origin" of the pulling movement is above and in front of the person. This allows the person during the double-poling movement to fully stretch (i.e., pre-load) his or her latissimus dorsi muscles—the main pulling muscles of the back. In addition, this "origin" allows the stomach and hip flexor muscles to be pre-loaded/stretched while the latissimus dorsi are fully extended, as well. Optimal power transfer is achieved when these muscle groups are stretched/pre-loaded as described.

The second key aspect of the present invention is that by the use of a flexible or pivotable connector, the hand grips of the present invention can follow the radial motion that the arms move through in the middle of the double-poling movement, even as the length of the pendulum is increased. Being a key to achieving the utmost skiing speed possible on snow, this lengthening of the effective radius of the arms is highly desirable. This feature of the apparatus of the present invention is critical to obtaining the near-ideal double-poling motion in a biomechanical sense.

The third key aspect of the present invention is that no support is provided (aside from grasping the handle ends) for the person's body. This necessitates the natural ski-specific and harmonious coordination between the muscle groups involved. Virtually all previous ski-movement-emulating apparatuses support at least a portion of the user's body. A consequence of supporting a portion of the body is that the muscle groups on either side of that supported body portion are isolated and cannot perform their 'normal' linking and stabilizing function during the movement. Deletion of these ski-specific functions significantly impairs the effectiveness of the exercise. This tends to counter the achievement of optimal double-poling technique as the hip flexors are not engaged, nor are the surrounding hip/pelvis stabilizers.

DETAILED DESCRIPTION OF THE PREFERRED EMBODIMENT

Figure 1:
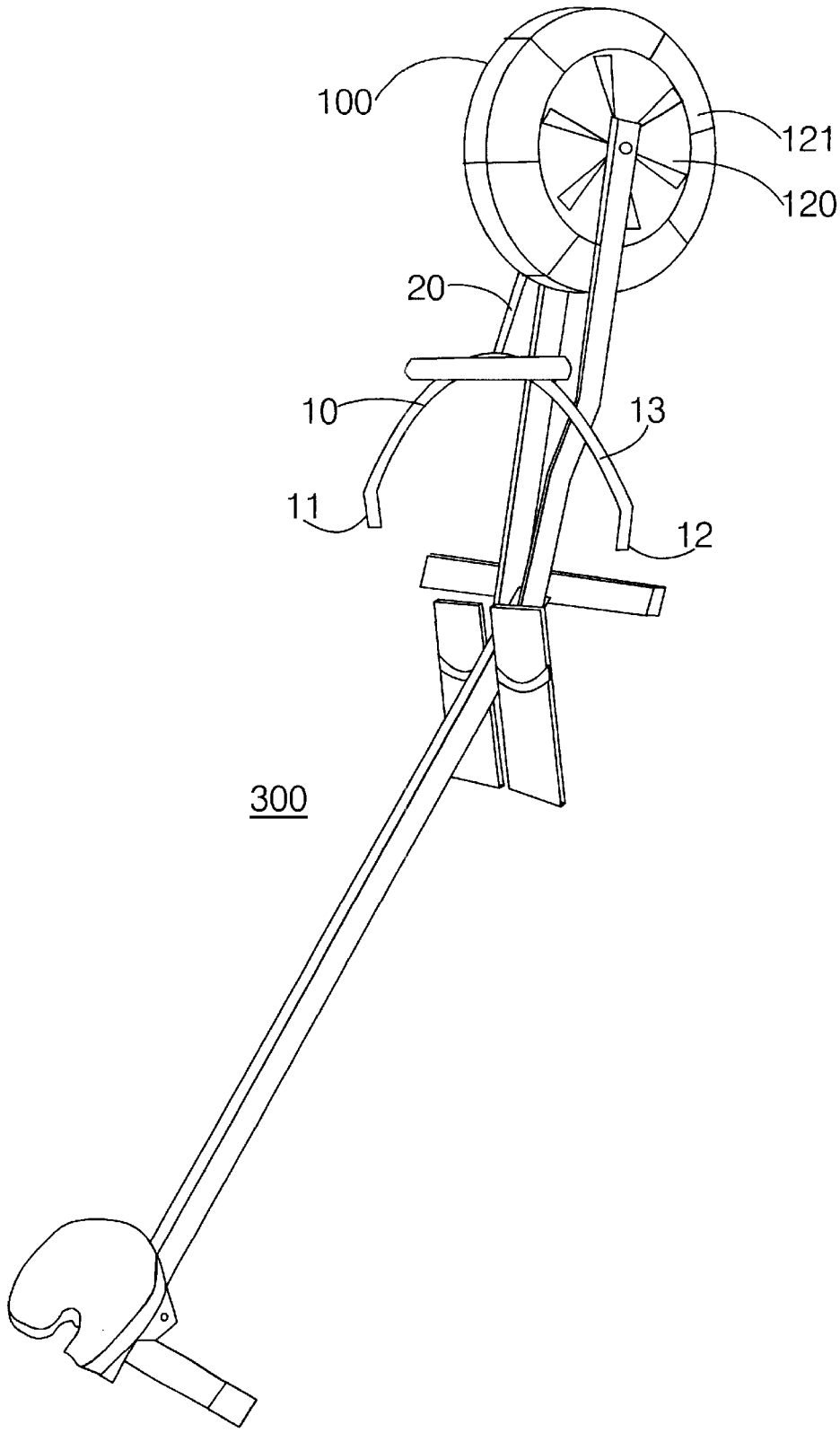
FIG. 1 shows the Preferred Embodiment of the Apparatus of the present invention.

FIG. 1 shows the Preferred Embodiment of the Apparatus 300 of the present invention. This Apparatus 300 includes a resistance force generator 100, a double-poling handle 10, and a cable 20 to provide a connection between the double-poling handle 10 and the resistance force generator 100. The cable 20 and resistance force generator 100 are shown in FIG. 1. The resistance force generator 100 includes a rotating flywheel 120 that has fan blades 121 attached in radial configuration.

In the Preferred Embodiment the double-poling handle 10 is substantially rigid and is made from ¾ in. (outer diameter) electrical conduit. The double-poling handle 10 has a left-hand-handle 11 and a right-hand-handle 12, each being adapted to be gripped by a user's hands. An intermediate handle-portion 13 connects the left-hand handle-handle 11 to the right-hand-handle 12. This intermediate handle-portion 13 has a "U" shape that allows the a user holding the double-poling handle 10 to move the left-hand-handle 11 and right-hand-handle 12 from a starting position in which the user's hands are in front of and well above the shoulders to a finishing position in which the user's hands are behind the body-midline, behind the user's back. In the Preferred Embodiment, the left-hand-handle 11 and the right-hand-handle 12 each curve, or are angled, slightly upward from a plane defined by the intermediate handle-portion 13 of the double-poling handle 10.

Figure 2:
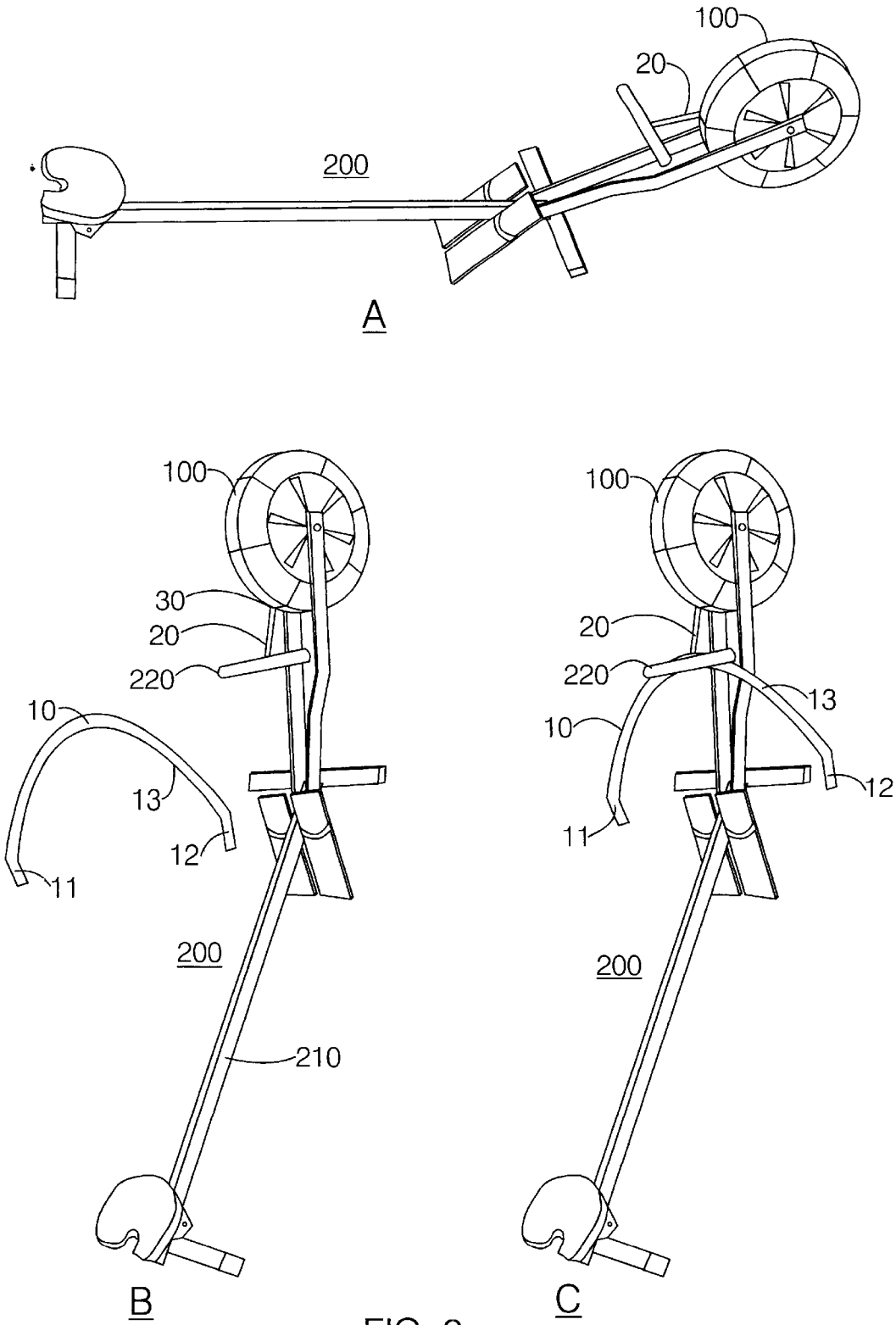
FIG. 2 shows the steps of the Preferred Embodiment of the Method of the present invention.

The steps of the Method of the present invention are shown in FIG. 2. A stationary-rowing machine 200 is adapted to include the essential characteristics of the Apparatus of the present invention, as described above. This stationary-rowing machine 200 is rotated so as to have a substantially vertical orientation as shown in FIG. 2. In this substantially vertical position, the cable 20 that connects the operating handle 220 of the stationary-rowing machine 200 has an "origin" 30 at a height above the ground approximately equal to the length of the longitudinally-extended frame 210 of the stationary-rowing machine 200. Next, the double-poling handle 10 is interlocked with the operator handle 220 of the stationary rowing-machine 200. In the Preferred Embodiment of the present invention, the resistance force generator 100 and cable 20 are provided by a CONCEPT II INDOOR ERGOMETER.

Figure 3:
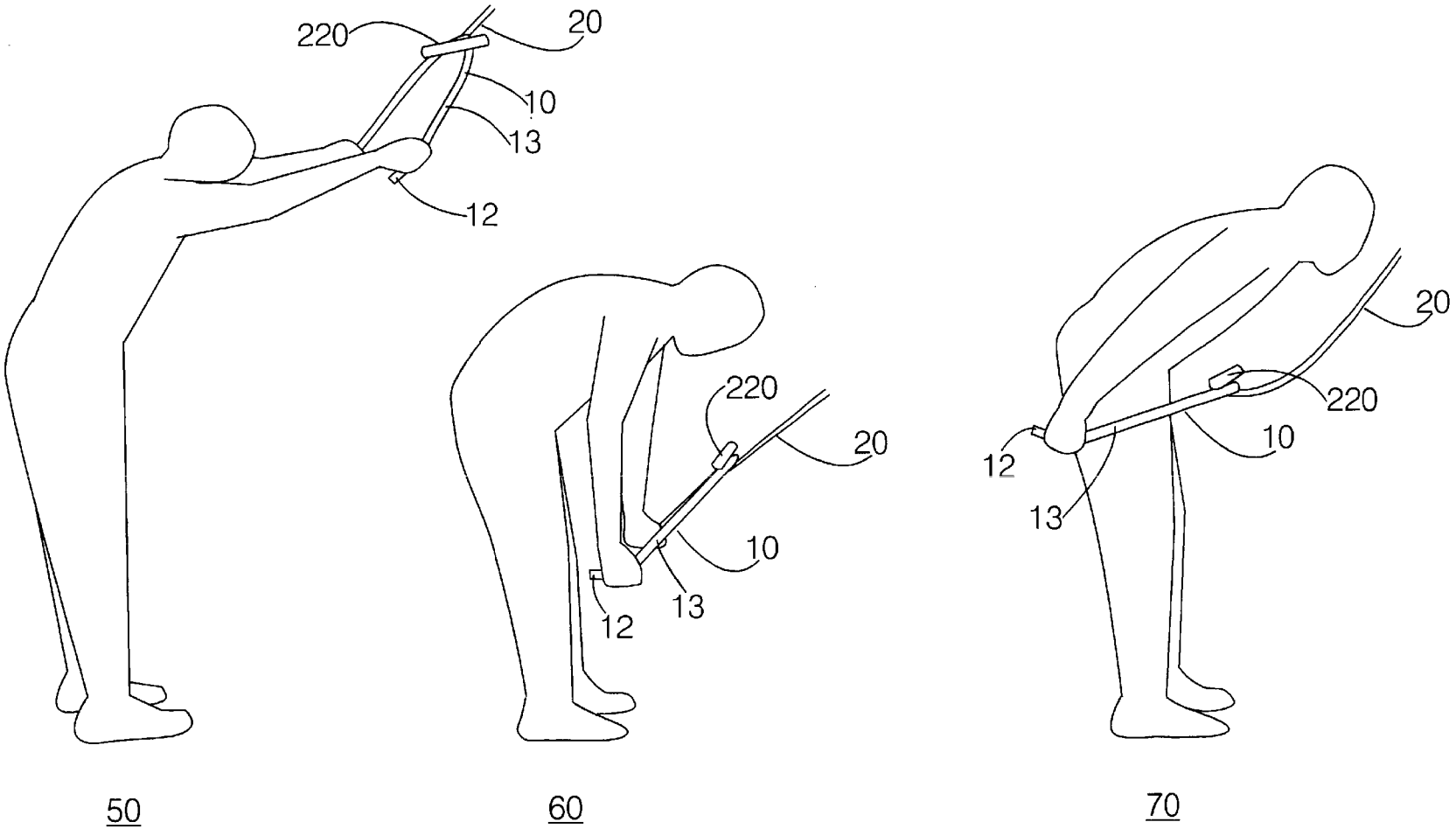
FIG. 3 shows the double-poling handle of the Preferred Embodiment in each of the starting, intermediate, and finishing positions of the double-poling ski-movement.

FIG. 3 illustrates the exercise method of the Preferred Embodiment. The double-poling handle 10 (coupled to the operating handle 220) is depicted in a starting position 50, an intermediate position 60, and a finishing position 70. In the starting position 50, the user grasps the left and right ends of the double-poling handle 10, with the double-poling handle 10 being above and in front of shoulders of the user. As is also shown in FIG. 3, the cable 20 supplies a tensile force to the operator handle 220, the force being directed up from and away from the operator handle 220 (i.e., diagonally towards the top of the now vertical stationary rowing machine 200). This operator handle 220 is coupled to the double-poling handle 10. The user pulls the double-poling handle 10 downward and toward his or her knees in an inverted arcing movement, as is exemplified by the intermediate position 70 shown in FIG. 3. The finishing position 60 is reached with the hands at a point past the body-midline on the back side. Due to the position of the origin of the cable 20, the force that the user has to overcome during the movement is upward and away from the user. In this way, the force that the user has to overcome is nearly identical to that which he or she would experience performing the double-poling technique on skis, on snow.

The above is but a single description of the present invention and is not intended to limit the present invention in any way. The present invention will have increased utility as, inter alia, new forms of connections and resistance force generators are developed.

Having described my invention, I claim:

1. An exercise apparatus for improving double-pole ski technique, said apparatus comprising:

a rigid double-poling handlebar having a body-receiving area;

a resistance force generator; and a connector that links said double-poling handlebar with said resistance force generator, wherein said connector exerts a tensile force on said double-poling handlebar;

wherein said double-poling handlebar has a substantially U-shape formed by a first intermediate section and a second intermediate section and a central section therebetween, said central section providing a concave end and said first and second intermediate sections extending from said concave end a distance greater than a thickness of a torso of a user and forming an open end;

wherein said body-receiving area is bounded by said open end, said concave end, said first intermediate section, and said second intermediate section;

wherein, when said double-poling handlebar is mounted on said connector and ready for use by said user standing in an upright position and facing said concave end, said open end is disposed between said concave end and said user and said tensile force is directed upward and away from said user;

wherein said first intermediate section has a first gripping end and said second intermediate section a second gripping end, each said gripping end being adapted to be gripped by a corresponding first hand and second hand of said user such that, when gripping said first gripping end with said first hand and said second gripping end with said second hand, a palm of said first hand is disposed parallel to and facing a palm of said second hand; and wherein said body-receiving area is adapted to allow a body of said user to pass through said open end into said body-receiving area as said user moves said double-poling handlebar from a first position, in which said first gripping end and said second gripping end are disposed in front of and at or above shoulder level of said user, to a second position, in which said first gripping end and said second gripping end are behind said body at a level defined by fully extended arms of said user.

2. The exercise apparatus of claim 1, wherein material for said force connector is selected from the group consisting of a chain, a rope, a strap, a cord and a cable.

3. The exercise apparatus of claim 2 further comprising a longitudinally extended frame having a first end and a second end, and a brake, wherein said resistance force generator is a flywheel rotatably mounted said first end of said frame, said second end of said frame is fixedly attached to said apparatus, and said brake is coupled to said flywheel.

4. An exercise apparatus for improving double-pole ski technique, for use by a user standing in an upright position, said apparatus comprising:

a rigid double-poling handlebar having a substantially U-shape having two intermediate sections with a central section therebetween, each one of said two intermediate sections having an end to which a handle is attached, a concave side of said U-shape being oriented toward a user of said apparatus and each said handle being adapted to be gripped by a user's hand, wherein said double-poling handlebar is adapted to allow entry of said user's body between each of said two intermediate sections as said user moves said double-poling handlebar from a first position in which each said handle is in front of said user to a second position in which each said handle is in back of said user and said user's body is between said two intermediate sections;

a resistance force generator providing a force origin that is situated higher than and on a convex side of said double-poling handlebar; and a connector between said double-poling handlebar and said resistance force generator, said connector having a proximate end and a distal end, said proximate end being connected directly to said double-poling handlebar, and said distal end being connected to said force generator, wherein said connector exerts a tensile force on said double-poling handlebar in a direction toward said force origin.

5. The exercise apparatus of claim 2, wherein said resistance force generator comprises elastomeric material.

6. An improvement in a stationary-rowing apparatus, said apparatus having a longitudinally-extended frame converted to be vertically positioned, a flywheel rotatably disposed in an upper portion of said frame, braking means coupled to said flywheel, an operating handle for turning said flywheel, and a drive means connecting said flywheel to said operating handle, said improvement comprising:

a rigid double-poling handlebar adapted to be mounted on said operating handle, said double-poling handlebar having a body-receiving area;

wherein said double-poling handlebar has a substantially U-shape formed by a first intermediate section and a second intermediate section and a central section therebetween, said central section providing a concave end and said first and second intermediate sections extending from said concave end a distance greater than a thickness of a torso of a user and forming an open end;

wherein, when said double-poling handlebar is mounted on said operating handle and ready for use by a user, said concave end of said double-poling handlebar is oriented toward said user and said open end is disposed between said concave end and said user, wherein said first intermediate section has a first gripping end and said second intermediate section a second gripping end, each said gripping end being adapted to be gripped by a corresponding first hand and second hand of said user such that, when gripping said first gripping end with said first hand and said second gripping end with said second hand, a palm of said first hand is disposed parallel to and facing a palm of said second hand; and wherein said body-receiving area is adapted to allow a body of said user to pass through said open end into said body-receiving area as said user moves said double-poling handlebar from a first position, in which said first gripping end and said second gripping end are disposed in front of and at or above shoulder level of said user, to a second position, in which said first gripping end and said second gripping end are behind said body at a level defined by fully extended arms of said user.

7. The improvement of claim 6, wherein said brake includes a bladed fan.

* * * * *